US006421963B1

(12) United States Patent
Pratola

(10) Patent No.: US 6,421,963 B1
(45) Date of Patent: Jul. 23, 2002

(54) TOY IGLOO DEVICE

(76) Inventor: Anthony M Pratola, 7936 Oakleaf, Elmwood Park, IL (US) 60707

( * ) Notice: Subject to any disclaimer, the term of this patent is extended or adjusted under 35 U.S.C. 154(b) by 0 days.

(21) Appl. No.: 09/766,461

(22) Filed: Jan. 19, 2001

(51) Int. Cl.[7] ..... E04B 7/08

(52) U.S. Cl. ..... 52/81.1; 52/81; 52/80.1; 135/94; D30/108

(58) Field of Search ..... 52/81.1, 81.5; 249/209, 184

(56) References Cited

U.S. PATENT DOCUMENTS

| | | | | |
|---|---|---|---|---|
| 4,154,423 A | | 5/1979 | Crock | |
| 4,665,664 A | * | 5/1987 | Knight | 52/81 |
| 5,205,772 A | | 4/1993 | Kennard et al. | |
| 5,377,460 A | * | 1/1995 | Hicks | 52/81.1 |
| D360,709 S | * | 7/1995 | Northrop et al. | D30/108 |
| 5,485,701 A | * | 1/1996 | Hecht | 52/80.1 |
| 5,522,181 A | | 6/1996 | Ellsworth | |
| 5,675,941 A | | 10/1997 | Dykmans | |
| 5,715,854 A | * | 2/1998 | Andrieux et al. | 135/94 |
| 6,324,791 B1 | * | 12/2001 | Azpiroz Villar | 52/80.1 |

* cited by examiner

*Primary Examiner*—Carl D. Friedman
*Assistant Examiner*—Steve Varner
(74) *Attorney, Agent, or Firm*—David J. Archer

(57) ABSTRACT

A toy igloo device is disclosed for resting on the ground. The device includes a dome shaped housing which defines an enclosure and an entrance. The housing includes a plurality of selectively interlocking sections with each section of the plurality of sections having an edge which rests on the ground. A first section of the plurality of sections defines a first opening and a second section of the plurality of sections is disposed adjacent to the first section. The second section defines a second opening so that the first and the second openings cooperate with each other to define the entrance. Each of the sections has an external surface which defines at least two pockets for the reception therein of snow. The arrangement is such that when the sections are interlocked, with the edges of the sections resting on the ground, snow is received and gathered within the pockets such that the toy igloo takes on an appearance of an Eskimo dwelling.

14 Claims, 8 Drawing Sheets

TOY IGLOO DEVICE

BACKGROUND OF THE INVENTION

1. Field of the Invention

The present invention relates to a toy igloo device for resting on the ground. More specifically, the present invention relates to a toy igloo device which when covered with snow takes on an appearance of an Eskimo dwelling.

2. Information Disclosure Statement.

In the winter time, children often enjoy playing in the snow and such play sometimes includes the collecting of snow together in order to make a snow fort or igloo.

The making of a toy igloo includes compacting blocks of snow to form building blocks. Such building blocks are arrayed first as a circular base and then with succeeding layers of the blocks each having a slightly smaller diameter to an underlying layer so that as the building proceeds, a dome shaped enclosure is formed.

However, the aforementioned procedure for building a toy igloo type structure from blocks of snow is time consuming and requires considerable building skill and patience.

Furthermore, although the resultant igloo when properly constructed may last through the winter, such igloo will melt if the temperature rises during a warm spell in the winter. Such melting of a toy igloo can prove to be very disappointing to a young child especially after spending much time on building such igloo from individual blocks of ice or snow.

The present invention overcomes the aforementioned problem associated with known toy igloo devices by the provision of a device which includes a dome shaped housing having pockets for the reception therein of snow. The arrangement is such that when the housing is assembled, snow during a snow fall will cover the housing so that the housing takes on an appearance of an Eskimo dwelling.

Furthermore, snow can be hand-packed onto the pockets of the housing so that the housing resembles an Eskimo dwelling or igloo.

Therefore, it is a primary feature of the present invention to provide a toy igloo device that over-comes the problems associated with the prior art arrangements and that makes a considerable contribution to the art of providing children's toys and the like.

Other features and advantages of the present invention will be readily apparent to those skilled in the art by a consideration of the detailed description contained hereinafter taken in conjunction with the annexed drawings.

SUMMARY OF THE INVENTION

The present invention relates to a toy igloo device for resting on the ground. The device includes a dome shaped housing which defines an enclosure and an entrance. The housing includes a plurality of selectively interlocked sections with each section having an edge which rests on the ground. The first section defines a first opening and a second section is disposed adjacent to the first section and defines a second opening. The first and the second openings cooperate with each other to define the entrance.

Each of the sections has an external surface which defines at least two pockets for the reception therein of snow. The arrangement is such that when the sections are interlocked, with the edges of the sections resting on the ground, snow is received and gathered within the pockets such that the toy igloo takes on an appearance of an Eskimo dwelling.

In a more specific embodiment of the present invention, the housing includes four interlocking sections.

Also, each of the sections includes a first lateral ridge which defines a plurality of holes. A second lateral ridge is spaced from the first ridge with the second ridge defining a further plurality of holes. The arrangement is such that adjacent sections interlock when the holes of the first ridge are aligned with the further holes of an adjacent section. A fastener extends through a hole of the first ridge and an aligned further hole of an adjacent second ridge for fastening together the first ridge of a second section to a second ridge of an adjacent first section. Each of the edges cooperates with an edge of an adjacent section so that the edges define an arc, with the arc resting on the ground.

The first section includes a first rib and the second section includes a second rib so that the first and second ribs cooperate together to define the entrance. The first rib defines a plurality of apertures and the second rib defines a further plurality of apertures. The igloo device also includes an entry which is secured to the entrance, the entry having an inverted U-shaped portion which defines a plurality of bores. Each of the bores is aligned with a corresponding aperture of the first and the second rib. A plurality of anchors are arranged such that each anchor extends through one of the apertures and aligned bores for anchoring the entry to the entrance.

The igloo according to the present invention also includes a vent cap which is secured to the interlocking sections for venting the enclosure.

More specifically, the vent cap includes a cylindrical chimney having a first and a second end. An extension is disposed coaxially relative to the chimney, the extension having a first and a second extremity. The first extremity is secured to the second end of the chimney.

Additionally, each of the sections further defines a lip so that the lip is disposed remote from the edge. The arrangement is such that when the sections are interlocked, each lip conforms to a lip of an adjacent section so that the lips define an outlet which cooperates with the vent cap.

In a preferred embodiment of the present invention, each section includes four rows of pockets with the pocket adjacent to the edge being larger than a pocket disposed remote from the edge.

More specifically, each pocket decreases in size from the pocket adjacent to the edge.

Many variations and modifications of the present invention will be readily apparent to those skilled in the art by a consideration of the detailed description contained hereinafter. However, such modifications and variations fall within the spirit and scope of the present invention as defined by the annexed claims.

BRIEF DESCRIPTION OF THE DRAWINGS

Similar reference character refer to similar parts throughout the various views of the drawings.

DETAILED DESCRIPTION OF THE DRAWINGS

Figure 1:
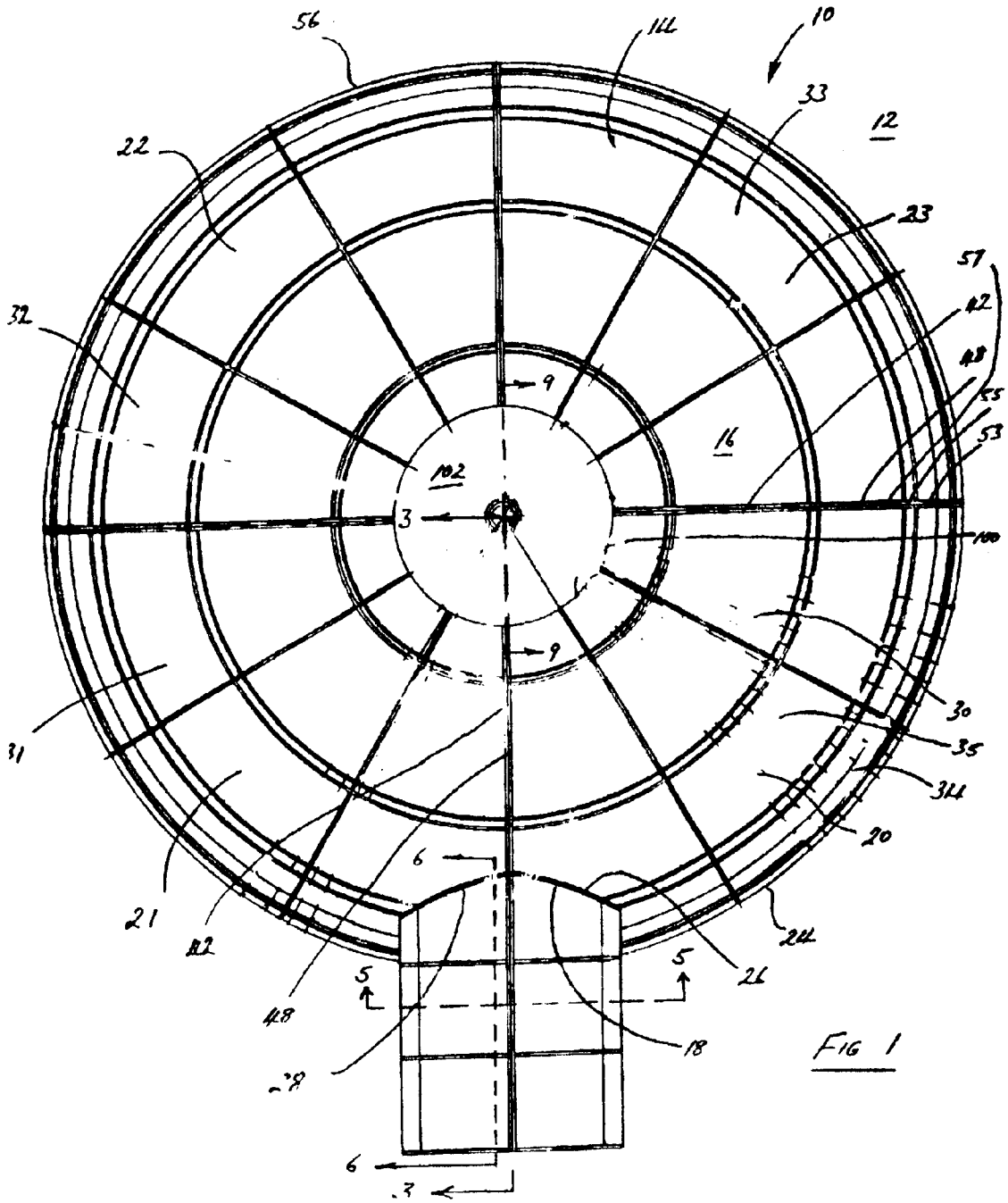
FIG. 1 is a top plan view of a toy igloo device according to the present invention.

FIG. 1 is a top plan view of a toy igloo device generally designated 10 according to the present invention. As shown in FIG. 1, the toy igloo device 10 rests on the ground 12. The device 10 includes a dome shaped housing generally designated 14 which defines an enclosure 16 and an entrance 18. The housing 14 includes a plurality of selectively interlocking sections 20, 21, 22 and 23 with each section such as section 20 of the plurality of sections 20–23 having an edge 24 for resting on the ground 12.

A first section 20 of the plurality of sections 20–23 defines a first opening 26 and a second section 21 of the plurality of sections 20–23 is disposed adjacent to the first section 20. The second section 21 defines a second opening 28. The arrangement is such that the first and the second openings 26 and 28 respectively cooperate with each other to define the entrance 18.

Each of the sections 20–23 has an external surface 30, 31, 32 and 33 respectively. The external surface such as surface 30 of section 20 defines at least two pockets 34 and 35 for the reception therein of snow. The arrangement is such that when the sections 20–23 are interlocked with the edge 24 of the section such as section 20 resting on the ground 12, snow is received and gathered within the pockets 34–35 such that the toy igloo device 10 takes on an appearance of an Eskimo dwelling.

Figure 2:
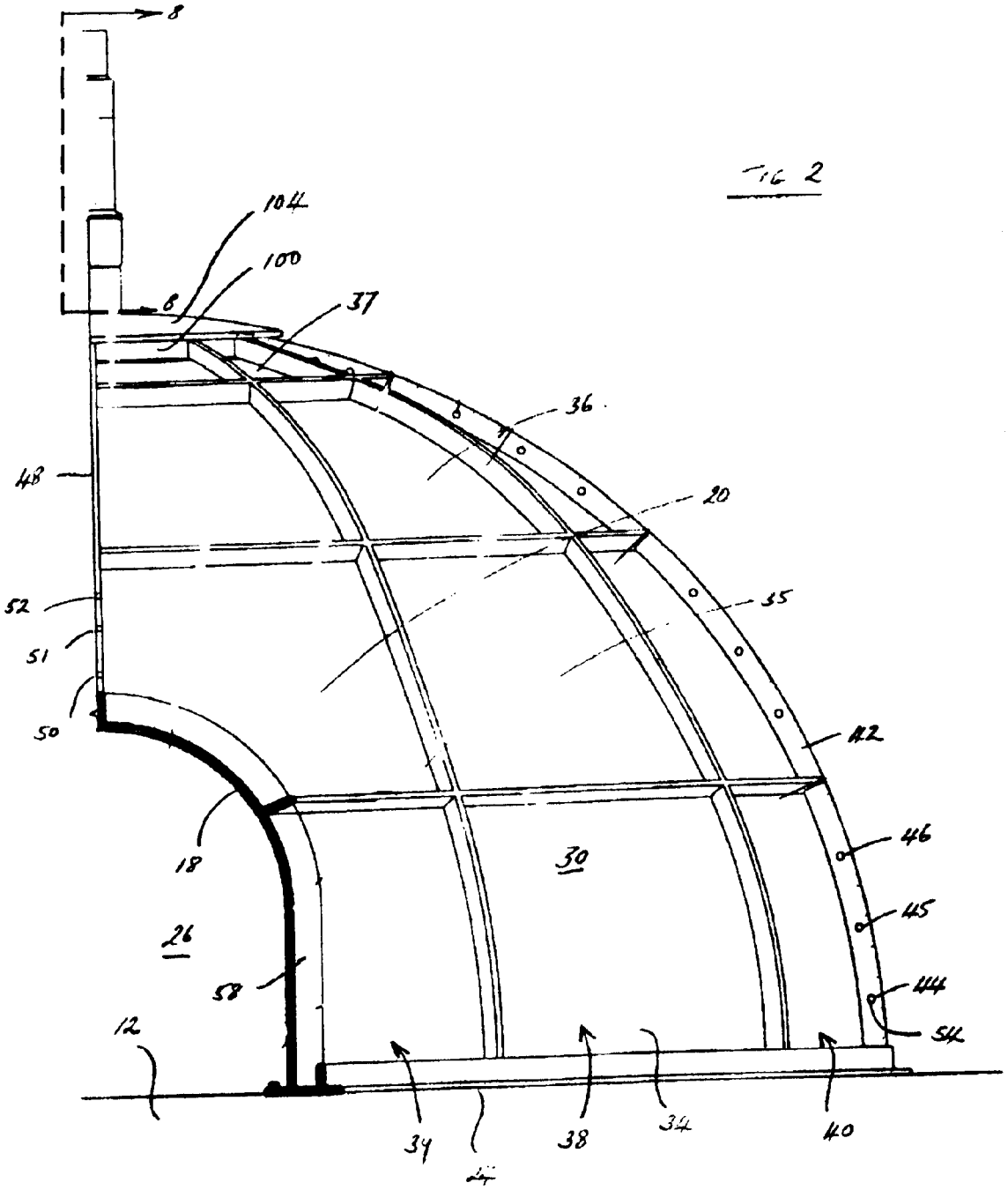
FIG. 2 is an enlarged side elevational view of a first section of the toy igloo device shown in FIG. 1.

FIG. 2 is an enlarged side elevational view of one of the sections 20 of the toy igloo device 10 shown in FIG. 1. As shown in FIG. 2, the section 20 includes four pockets 34, 35, 36 and 37 disposed in a column generally designated 38. The section 20 also includes further columns 39 and 40 disposed on each side of the column 38.

The housing 14 includes four interlocking sections 20–23 as shown in FIG. 1. Each of the sections such as section 20 shown in FIG. 2 includes a first lateral ridge 42 which defines a plurality of holes 44, 45 and 46.

A second lateral ridge 48 is spaced from the first ridge 42. The second ridge 48 defines a further plurality of holes 50, 51 and 52. The arrangement is such that adjacent sections such as sections 20 and 23 interlock when the holes 44–46 of the first ridge 42 of the first section 20 are aligned with further holes 53, 55 and 57 of the second ridge 48 of the adjacent section 23 as shown in FIG. 1.

A fastener 54 extends through a hole 44 of the first ridge 42 of the first section 20 and the aligned further hole 53 of the adjacent second ridge 48 of section 23 for fastening together the first ridge 42 of the section 20 to the second ridge 48 of the adjacent section 23 as shown in FIG. 1.

Each of the edges such as edge 24 of section 20 cooperates with the edge of an adjacent section such as section 23 so that the edges define an arc 56, the arc 56 resting on the ground 12.

Figure 3:
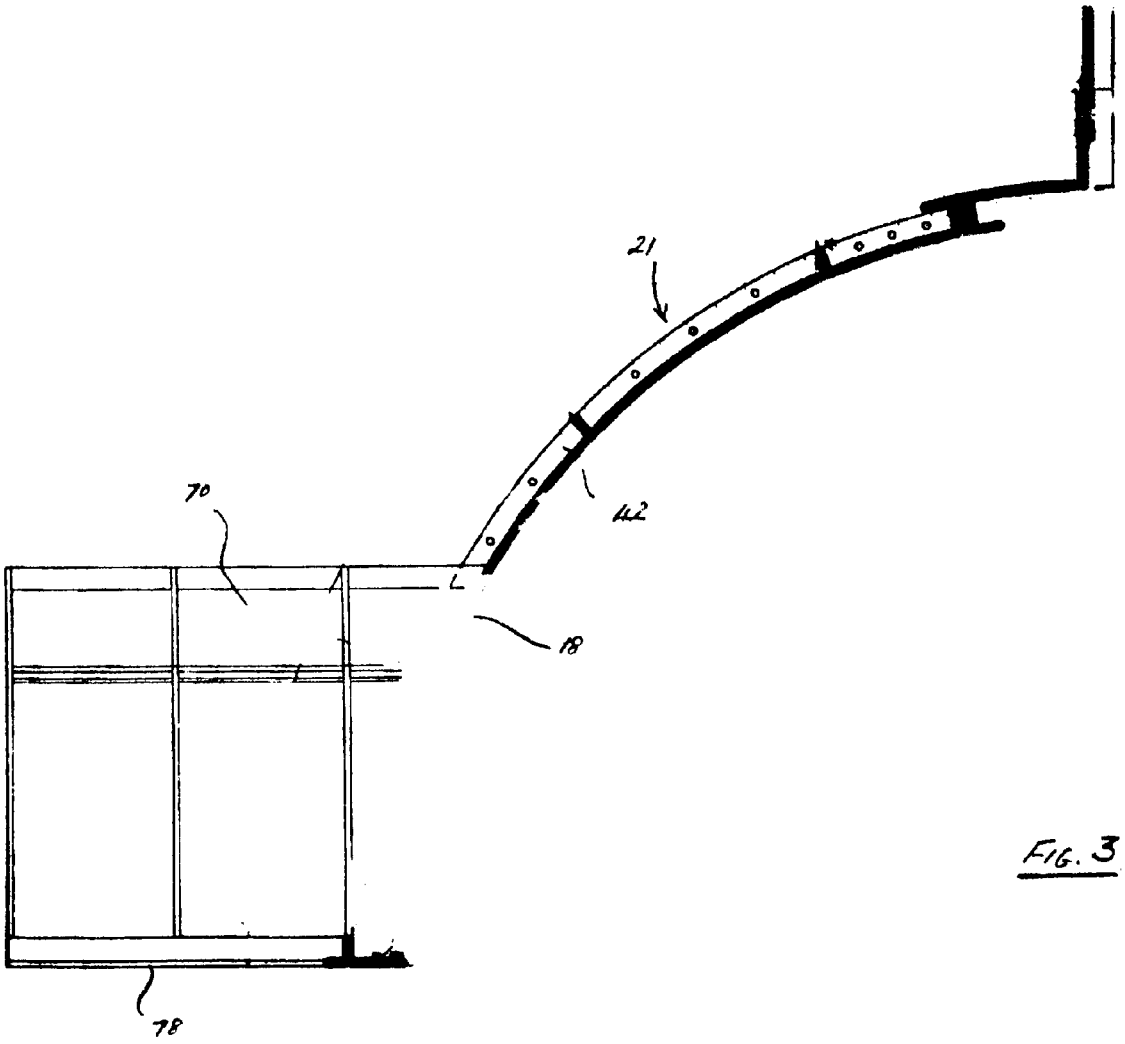
FIG. 3 a sectional view taken on the line 3—3 of FIG. 1.

FIG. 3 is a sectional view taken on the line 3—3 of FIG. 1. As shown in FIG. 3, the second section 21 includes a first ridge 42.

Figure 4:
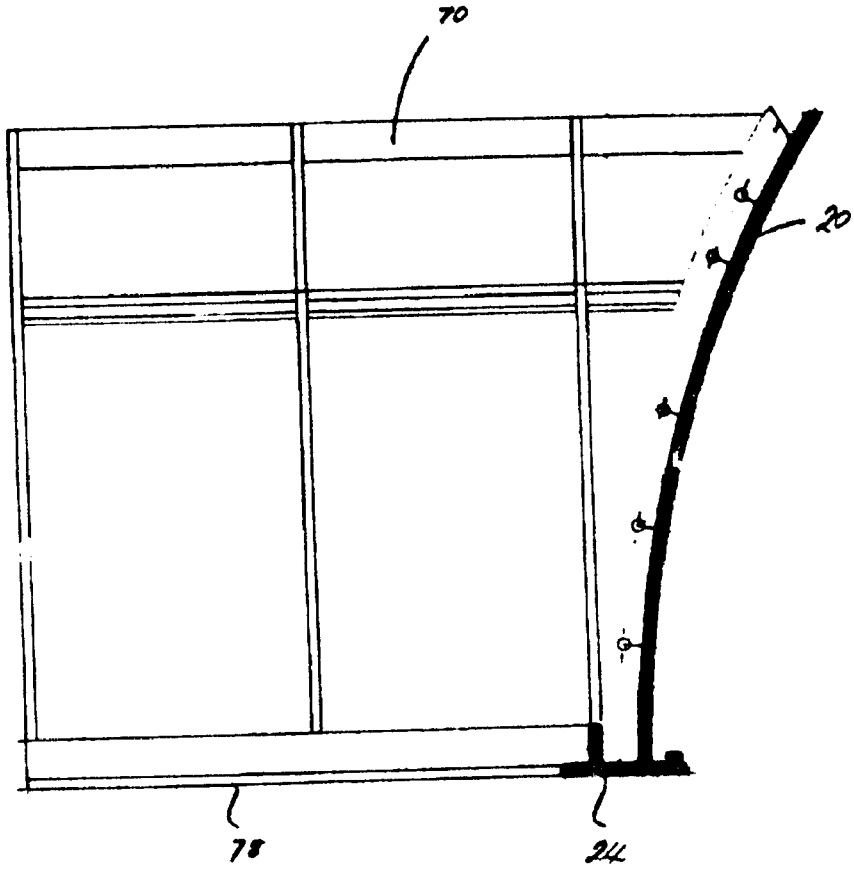
FIG. 4 an enlarged side elevational view of the entry of the toy igloo device shown in FIG. 1.

FIG. 4 is an enlarged side elevational view of the entry of the toy igloo device shown in FIG. 1. As shown in FIG. 4, an entry 70 is secured to the first section 20 and to the second section.

Figure 5:
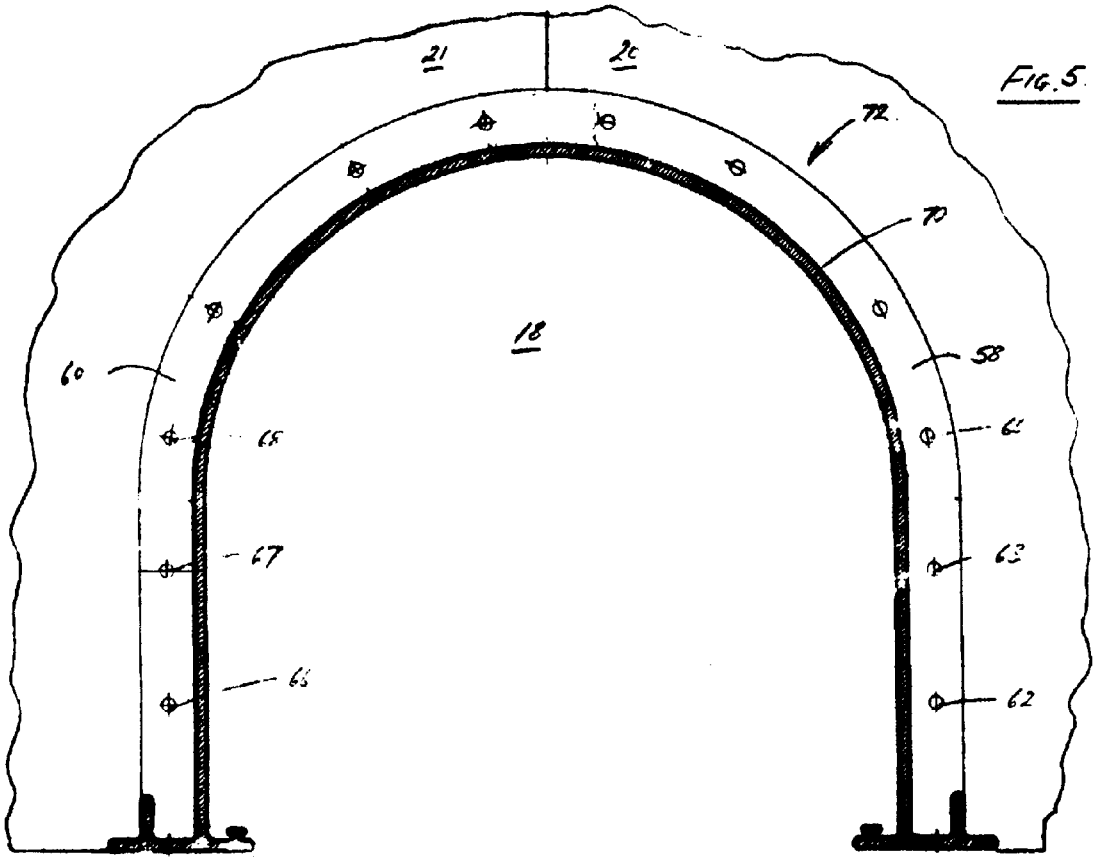
FIG. 5 is an enlarged sectional view taken on the line 5—5 of FIG. 1.

FIG. 5 is an enlarged sectional view taken on the line 5—5 of FIG. 1. As shown in FIG. 5, the first section 20 includes a first rib 58 and the second section 21 includes a second rib 60. The first and the second ribs 58 and 60 cooperate together to define the entrance 18.

The first rib 58 defines a plurality of apertures 62, 63 and 64 and the second rib 60 defines a further plurality of apertures 66, 67 and 68.

Figure 6:
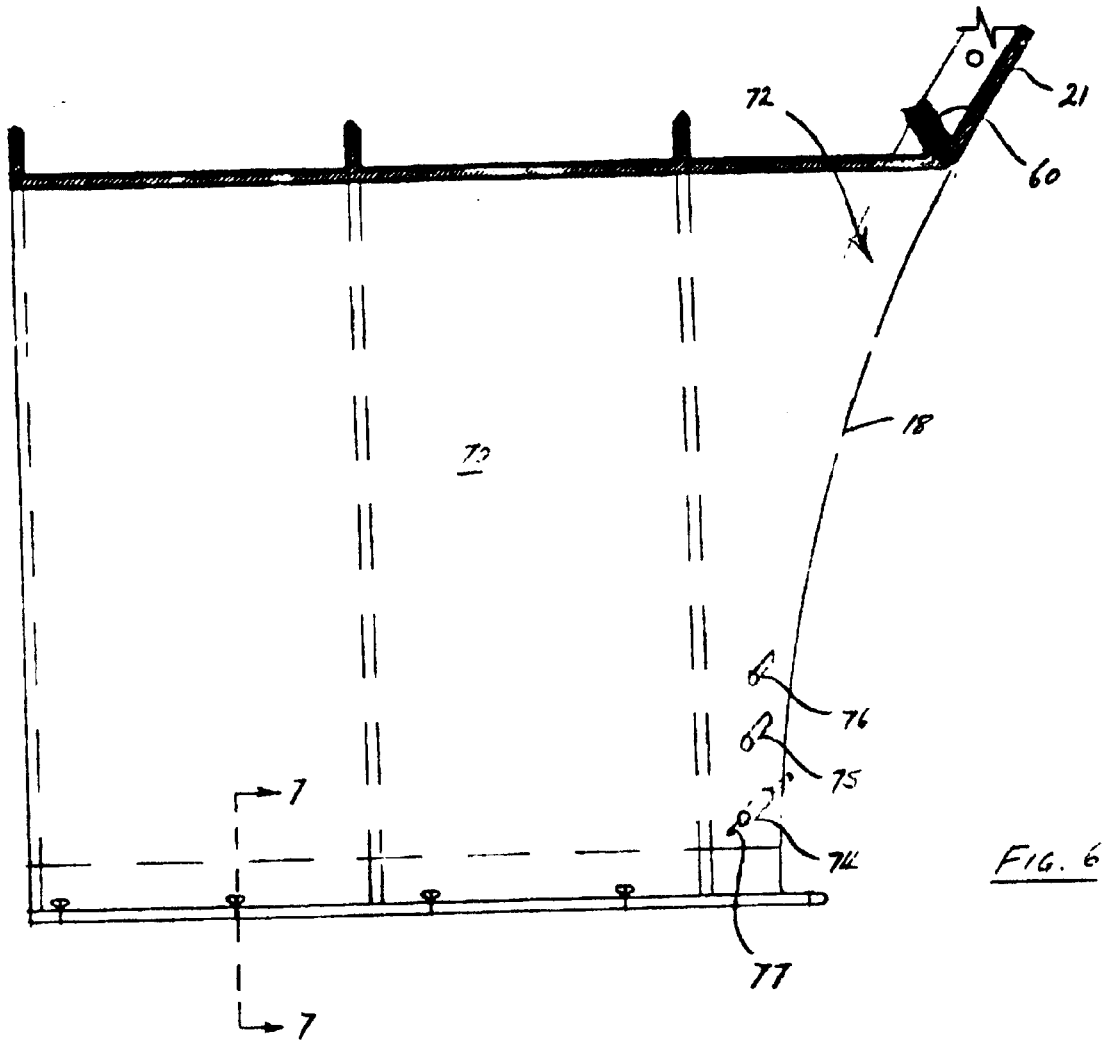
FIG. 6 is an enlarged sectional view taken on the line 6—6 of FIG. 1.

FIG. 6 is an enlarged sectional view taken on the line 6—6 of FIG. 1. As shown in FIG. 6, the igloo device 10 also includes the entry 70 which is secured to the entrance 18. The entry 70 has an inverted U-shaped portion generally designated 72 as shown in FIG. 5 which defines a plurality of bores 74, 75 and 76. Each of the bores 74–76 is aligned with a corresponding aperture 62–64 and 66–68 of the first and the second rib 58 and 60 respectively. A plurality of anchors such as anchor 77 are arranged such that the anchor 77 extends through one of the apertures 66 and aligned bore 74 for anchoring the entry 70 to the entrance 18.

Figure 7:
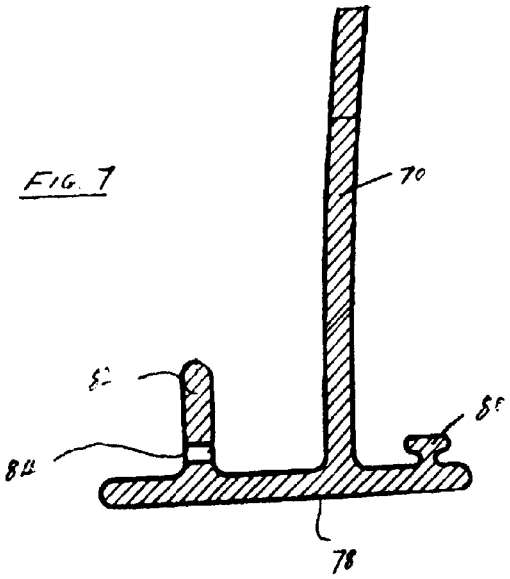
FIG. 7 is an enlarged sectional view taken on the line 7—7 of FIG. 6.

FIG. 7 is an enlarged sectional view taken on the line 7—7 of FIG. 6. As shown in FIG. 7, the entry 70 has a base 78 which defines several tarp supports 80 one of which is shown. Also, the base 78 includes an upstanding ledge 82 which defines a plurality of drains 84 for draining rain and melting snow.

Figure 8:
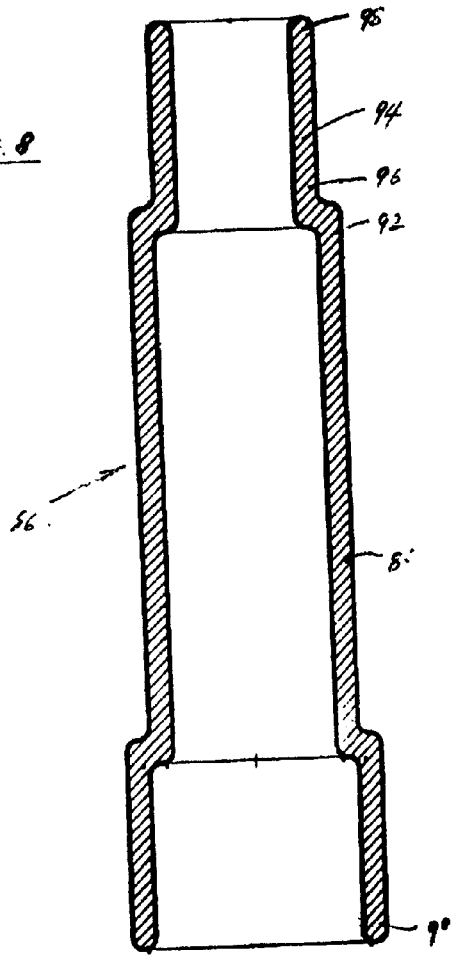
FIG. 8 is an enlarged sectional view taken on the line 8—8 of FIG.2 showing a vent cap extension.

FIG. 8 is an enlarged sectional view taken on the line 8—8 of FIG. 2 showing a vent cap extension generally designated 86. As shown in FIG. 8, the vent cap extension 86 is connected to the interlocking sections 20–23 for venting the enclosure 16.

More specifically, the vent cap extension 86 includes a cylindrical chimney 88 having a first and a second end 90 and 92 respectively. An extension 94 is disposed co-axially relative to the chimney 88 with the extension 94 having a first and a second extremity 96 and 98 respectively. The first extremity 96 is secured to the second end 92 of the chimney 88.

Each of the sections 20–23 such as section 20 further define a lip 100 with the lip 100 being disposed remote from the edge 24 as shown in FIGS. 1 and 2. The arrangement is such that when the sections 20–23 are interlocked, each lip 100 conforms to a lip of an adjacent section so that the lips 100 define a circular outlet 102 as shown in FIG. 1, which cooperates with a vent cap 104 as shown in FIG. 2.

Figure 9:
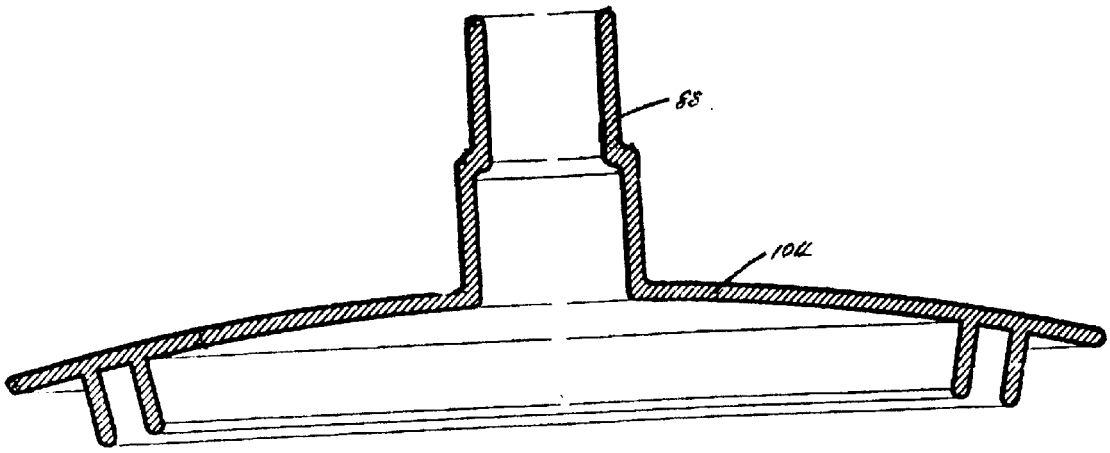
FIG. 9 is an enlarged sectional view taken on the line 9—9 of FIG. 1 showing a vent cap of the toy igloo device.

FIG. 9 is an enlarged sectional view taken on the line 9—9 of FIG. 1 showing the vent cap 104 of the toy igloo device 10.

In a preferred embodiment of the present invention, each section such as section 20 includes four pockets 34–37 in each column such as column 38 and each section includes three columns 38–40 as shown in FIG. 2. The pockets 34–37 are arranged such that the pocket 34 adjacent to the edge 24 is larger than the pocket 37 disposed remote from the edge 24. More particularly, each pocket of the pockets 34–37 decreases in size from the pocket 34 adjacent to the edge 24.

Additionally, each of the pockets 34–37 has a depth within the range 1.25–2.5" and preferably 1.75" so that snow is collected within each pocket. Also, each of the pockets 34–37 has a surface which is roughened so that in the absences of snow and in the event of children climbing on the toy igloo, slipping on the outer surface of the igloo is avoided.

Furthermore, the second extremity 98 of the vent cap extension 86 could include a cap. Moreover, although the vent cap may include two sections, it will be understood that the vent cap could be a single molding or could include several sections. Also, the base 78 of the entry 70 is preferably extended to provide a base for the entire toy igloo so that all of the sections 20–23 are connected to the base 78.

In operation of the device according to the present invention, the four sections or quadrants 20–23 are arranged such that the holes 44–46 of one section are aligned relative to the further holes 53, 55 and 57 of an adjacent section and fasteners 54 are inserted through the aligned holes 44–46 and 53, 55 and 57.

Next, the entry 70 is secured to the entrance 18 by means of the plurality of anchors such as anchor 77.

Finally, the vent cap 104 and vent cap extension 86 are secured to the outlet 102.

The present invention provides a unique toy igloo device which provides a play enclosure for children in winter time when covered with snow. However, the igloo device is also able to be used by children as a play house even in the absence of snow.

What is claimed is:

1. A toy igloo device for resting on the ground, said device comprising:

a dome shaped housing, said housing defining an enclosure and an entrance;

said housing including:

a plurality of selectively interlocking sections, each section of said plurality of sections having an edge resting on the ground;

a first section of said plurality of sections defining a first opening;

a second section of said plurality of sections disposed adjacent to said first section, said second section defining a second opening, said first and second openings cooperating with each other to define said entrance; and each of said sections having an external surface which defines at least two pockets for the reception therein of snow, the arrangement being such that when said sections are interlocked, with said edges of said sections resting on the ground, snow is received and gathered within said pockets such that said toy igloo takes on an appearance of an Eskimo dwelling.

2. A toy igloo device as set forth in claim 1 wherein said housing includes:

four interlocking sections.

3. A toy igloo device as set forth in claim 1 wherein each of said sections includes:

a first lateral ridge defining a plurality of holes;

a second lateral ridge spaced from said first ridge, said second ridge defining a further plurality of holes, the arrangement being such that adjacent sections interlock when said holes of said first ridge are aligned with said further holes of an adjacent section;

a fastener extending through a hole of said first ridge and an aligned further hole of an adjacent second ridge for fastening together said first ridge of a section to a second ridge of an adjacent section.

4. A toy igloo device as set forth in claim 1 wherein each of said edges cooperates with an edge of an adjacent section so that said edges define an arc, said arc resting on the ground.

5. A toy igloo devices as set forth in claim 1 wherein said first section includes a first rib;

said second section includes:

a second rib, said first and second ribs cooperating together to define said entrance.

6. A toy igloo devices as set forth in claim 5 wherein said first rib defines a plurality of apertures;

said second rib defines a further plurality of apertures;

said igloo device further including:

an entry which is secured to said entrance;

said entry having an inverted U-shaped portion which defines a plurality of bores, each of said bores being aligned with a corresponding aperture of said first and second rib;

a plurality of anchors, each anchor extending through one of said apertures and aligned bore for anchoring said entry to said entrance.

7. A toy igloo device as set forth in claim 1 further including:

a vent cap secured to said interlocking sections for venting said enclosure.

8. A toy igloo device as set forth in claim 7 wherein said vent cap includes:

a cylindrical chimney having a first and a second end;

an extension disposed coaxially relative to said chimney, said extension having a first and a second extremity, said first extremity being secured to said second end of said chimney.

9. A toy igloo device as set forth in claim 7 wherein each of said sections further defines a lip, said lip being disposed remote from said edge, the arrangement being such that when said sections are interlocked, each lip conforms to a lip of an adjacent section so that said lips define an outlet which cooperates with said vent cap.

10. A toy igloo device as set forth in claim 1 wherein each section includes:

at least four pockets.

11. A toy igloo device as set forth in claim 10 wherein said pocket adjacent to said edge is larger than a pocket disposed remote from said edge.

12. A toy igloo device as set forth in claim 1 wherein each pocket decreases in size from said pocket adjacent to said edge.

13. A toy igloo device for resting on the ground, said device comprising:

a dome shaped housing, said housing defining an enclosure and an entrance;

said housing including:

a plurality of selectively interlocking sections, each section of said plurality of sections having an edge resting on the ground;

a first section of said plurality of sections defining a first opening;

a second section of said plurality of sections disposed adjacent to said first section, said second section defining a second opening, said first and second openings cooperating with each other to define said entrance;

each of said sections having an external surface which defines pockets for the reception therein of snow, the arrangement being such that when said sections are interlocked, with said edges of said sections resting on the ground, snow is received and gathered within said pockets such that said toy igloo takes on an appearance of an Eskimo dwelling;

each section includes:

three columns;

each column having at least four pockets.

14. A toy igloo device for resting on the ground, said device comprising:

a dome shaped housing, said housing defaming an enclosure and an entrance;

said housing including:

a plurality of selectively interlocking sections, each section of said plurality of sections having an edge resting on the ground;

a first section of said plurality of sections defining a first opening;

a second section of said plurality of sections disposed adjacent to said first section, said second section defining a second opening, said first and second openings cooperating with each other to define said entrance;

each of said sections having an external surface which defines pockets for the reception therein of snow, the arrangement being such that when said sections are interlocked, with said edges of said sections resting on the ground, snow is received and gathered within said pockets such that said toy igloo takes on an appearance of an Eskimo dwelling; and an entry which is secured to said entrance.

* * * * *